US010694830B2

(12) United States Patent
Seguin et al.

(10) Patent No.: US 10,694,830 B2
(45) Date of Patent: Jun. 30, 2020

(54) CASE FOR A COSMETIC PRODUCT

(71) Applicant: ALBEA SERVICES, Gennevilliers (FR)

(72) Inventors: Franck Seguin, Auvers-sur-Oise (FR); Melodie Bazinval, Deuil-la-Barre (FR)

(73) Assignee: ALBEA SERVICES, Gennevilliers (FR)

( * ) Notice: Subject to any disclaimer, the term of this patent is extended or adjusted under 35 U.S.C. 154(b) by 140 days.

(21) Appl. No.: 16/010,392

(22) Filed: Jun. 15, 2018

(65) Prior Publication Data

US 2018/0360195 A1 Dec. 20, 2018

(30) Foreign Application Priority Data

Jun. 16, 2017 (FR) ..... 17 55502

(51) Int. Cl.

*A45D 40/22* (2006.01)
*A45D 33/00* (2006.01)
*A45D 42/04* (2006.01)

(52) U.S. Cl.

CPC ..... *A45D 40/221* (2013.01); *A45D 33/00* (2013.01); *A45D 33/006* (2013.01); *A45D 40/222* (2013.01); *A45D 42/04* (2013.01); *A45D 2040/225* (2013.01); *A45D 2200/1018* (2013.01)

(58) Field of Classification Search

CPC .... A45D 40/221; A45D 33/00; A45D 33/006; A45D 40/222; A45D 2040/225; A45D 2200/1018; A45D 42/04; B65D 43/163

USPC ..... 220/262–264, 810–849; 132/293–307

See application file for complete search history.

(56) References Cited

U.S. PATENT DOCUMENTS

| | | | | |
|---|---|---|---|---|
| 2,936,067 A * | 5/1960 | Kaskey | A45C 11/10 206/759 |
| 3,308,835 A * | 3/1967 | Silverberg | A45D 40/22 220/263 |
| 2003/0192892 A1* | 10/2003 | Fujita | B65D 50/061 220/291 |
| 2012/0104011 A1* | 5/2012 | Tsunoda | B60N 3/102 220/810 |
| 2015/0027487 A1* | 1/2015 | Apodaca | A45D 33/16 132/307 |

FOREIGN PATENT DOCUMENTS

| | | |
|---|---|---|
| EP | 0545817 | 6/1993 |
| KR | 20090004125 | 1/2009 |

* cited by examiner

*Primary Examiner* — James N Smalley

(74) *Attorney, Agent, or Firm* — Steven M. Greenberg, Esq.; Shutts & Bowen LLP

(57) ABSTRACT

A case for a cosmetic product includes a tray intended to receive the cosmetic product, an actuating means allowing for the passage of the tray from a rest position to a position of use, and a cover. The tray includes a notched zone able to cooperate with a toothed wheel of the cover in such a way that the passage of the tray from the rest position to the position of use results in the opening of the cover, and, reciprocally, the passage of the tray from the position of use to the rest position results in the closing of the cover.

11 Claims, 6 Drawing Sheets

CASE FOR A COSMETIC PRODUCT

CROSS-REFERENCE TO RELATED APPLICATIONS

This application claims priority under 35 U.S.C. ¬β119 (a) to French Patent Application No. 1755502, filed Jun. 16, 2017.

BACKGROUND OF THE INVENTION

Field of the Invention

The invention relates to a case for a cosmetic product. Such cases include a tray for receiving cosmetic products and a cover in order to close or open the case. As such, when the cover is in the open position, the user has access to the tray.

Description of the Related Art

Generally, cases for a cosmetic product include a housing configured to receive the cosmetic product and a cover. The cover is conventionally closed by snap-fitting or screwing. In the closed position, the cover protects the cosmetic product and the opening thereof allows the user to access the cosmetic product which is in the housing. According to the depth of the latter, the product may be difficult to access.

In other cases, the cosmetic product can be raised in order to facilitate the accessibility thereof, but the size is then more substantial.

There are still cases wherein the cosmetic product is arranged on a mobile tray. As such, after opening of the case, the user actuates a mechanism for displacing the tray and rendering the cosmetic product more accessible. This type of case requires a complex mechanism for the entry and/or the exit of the tray and also a more complex manipulation for the user who after opening of the cover must actuate the displacement of the tray in order to take it out and inversely after use.

There is therefore a need for a case for a cosmetic product that makes it possible to resolve the preceding disadvantages and which is of simple design and easy to use.

BRIEF SUMMARY OF THE INVENTION

Embodiments of the present invention address deficiencies of the art in respect to cases for cosmetic products and provide a novel and non-obvious method, system and computer program product for a case for a cosmetic product that includes:

- a tray intended to receive the cosmetic product,
- an actuating means that allow for a passage of the tray from a rest position to a position of use,
- a cover.

The tray includes a notched zone able to cooperate with a toothed wheel of the cover in such a way that the passage of the tray from the rest position to the position of use results in the opening of the cover—reciprocally the passage of the tray from the position of use to the rest position results in the closing of the cover.

In other words, this case includes a mechanism for actuating that allows for the opening and/or the closing of a cover simultaneously with the raising and/or the lowering of a tray including a cosmetic product. The raising of the tray allows for better accessibility of the cosmetic product and a limitation of the size in relation to a case wherein the tray is raised even in the rest position. In addition, a coupling of the raising and/or of the lowering of the tray at the opening and/or the closing simultaneously with the cover, makes it possible to limit for the user the number of steps to open/close the case then access the product. On the other hand, the system allows for the opening of a cover having a substantial weight, caused for example by the presence of a mirror.

According to different embodiments of the invention, which can be taking together or separately:

- the notched zone is a rack,
- the toothed wheel is a pinion,
- the actuation is caused by a rotation of the actuating means,
- the case further includes an intermediate ring that is fixed with respect to the actuating means,
- the intermediate ring includes on its inner surface at least one groove configured to cooperate with at least one cam of the tray in such a way as to allow the raising and/or the lowering of the tray,
- the actuating means includes a bottom part and an inner ring,
- the inner ring includes at least one slot configured to cooperate with the cam or cams of the tray in such a way as to drive in rotation the tray.
- the width of the cams of the tray is substantially identical to the width of the slot of the inner ring,
- the inner ring and the bottom part are two separate parts,
- the inner ring and the bottom part are a single part,
- the inner ring includes a first and a second concentric parts,
- the first part is located outside the second part,
- each one of the first and second parts includes at least one slot facing configured to cooperate with the cams of the tray in such a way as to allow the raising and/or the lowering of the tray,
- the second part further includes at least one cam configured to cooperate with the slot of the first part in such a way as to allow the raising and/or the lowering of the tray,
- the slot of the first part is divided into a so-called lower portion and a so-called upper portion, with the width of the lower portion being greater than the width of the upper portion,
- the cams of the tray have a radial extension different from a radial extension of the cams of the second part,
- the radial extension of the cams of the tray is greater than the radial extension of the cams of the second part,
- the width of the cams of the tray is different from the width of the cams of the second part,
- the width of the cams of the tray is less than the width of the cams of the second part,
- the width of the cams of the tray is substantially identical to the width of the slot of the second part,
- the width of the cams of the tray is substantially identical to the width of the upper portion of the slot of the first part,
- the width of the cams of the second part is substantially identical to the width of the lower portion of the slot of the first,
- the change in width of the slot of the first part is used as a stop for the cam of the second part in such a way as to block the second part in its displacement upwards, to allow the tray to rise up to the position of use and to allow for the opening of the cover,
- the wheel is fixed to the actuating means,
- the wheel is fixed to the inner ring of the actuating means,
- the wheel is fixed to the second part of the inner ring, the wheel is fixed by pivot connection according to an axis of rotation collinear to an axis Z perpendicular to a longitudinal axis X, the bottom part and the inner ring in a serrated assembly in such a way that the setting into rotation of the bottom part drives the rotation of the inner ring, the setting into rotation of the inner ring results in the raising and/or the lowering of the tray by cooperation with at least one cam of the tray with at least one groove of the intermediate ring and at least one slot of the inner ring, the case further includes an upper ring configured to pass from a high position wherein an outer surface of the cover and an outer surface of an upper radial edge of the upper ring are aligned, to a low position wherein the upper ring covers the intermediate ring, the top of the ring being below the outer surface of the cover, and inversely, in such a way as to allow the opening and/or the closing of the cover, the intermediate ring further includes on its outer surface at least one helical rib configured to cooperate with at least one helical groove located on the inner surface of the upper ring, the groove of the inner surface of the intermediate ring is helical, the groove of the upper ring and the rib of the intermediate ring are oriented in a direction opposite the groove of the inner surface of the intermediate ring in order to allow the upper ring to rise while the tray descends and inversely in such a way as to allow the opening and/or the closing of the cover, the cover includes an end portion configured to hide at least the toothed wheel in the rest position, the end portion is configured to serve as a stop for the cover in the position of use, the end portion is configured to hide the notched zone in the rest position, the end portion is configured to hide the inner ring in the rest position, the end portion is configured to hide the upper ring in the rest position, the end portion is configured to hide the intermediate ring in the rest position, the end portion is located on the toothed wheel of the cover, an interaxis between the axis of rotation of the toothed wheel and an inner surface of the end portion of the cover allows for the pivoting of the cover into the position of use, the interaxis correspond at least to a thickness of the inner ring, the interaxis corresponds to at least the sum of the thicknesses of the inner ring and of the intermediate ring, the interaxis corresponds at least to the sum of the thicknesses of the inner ring, of the intermediate ring and of the upper ring.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
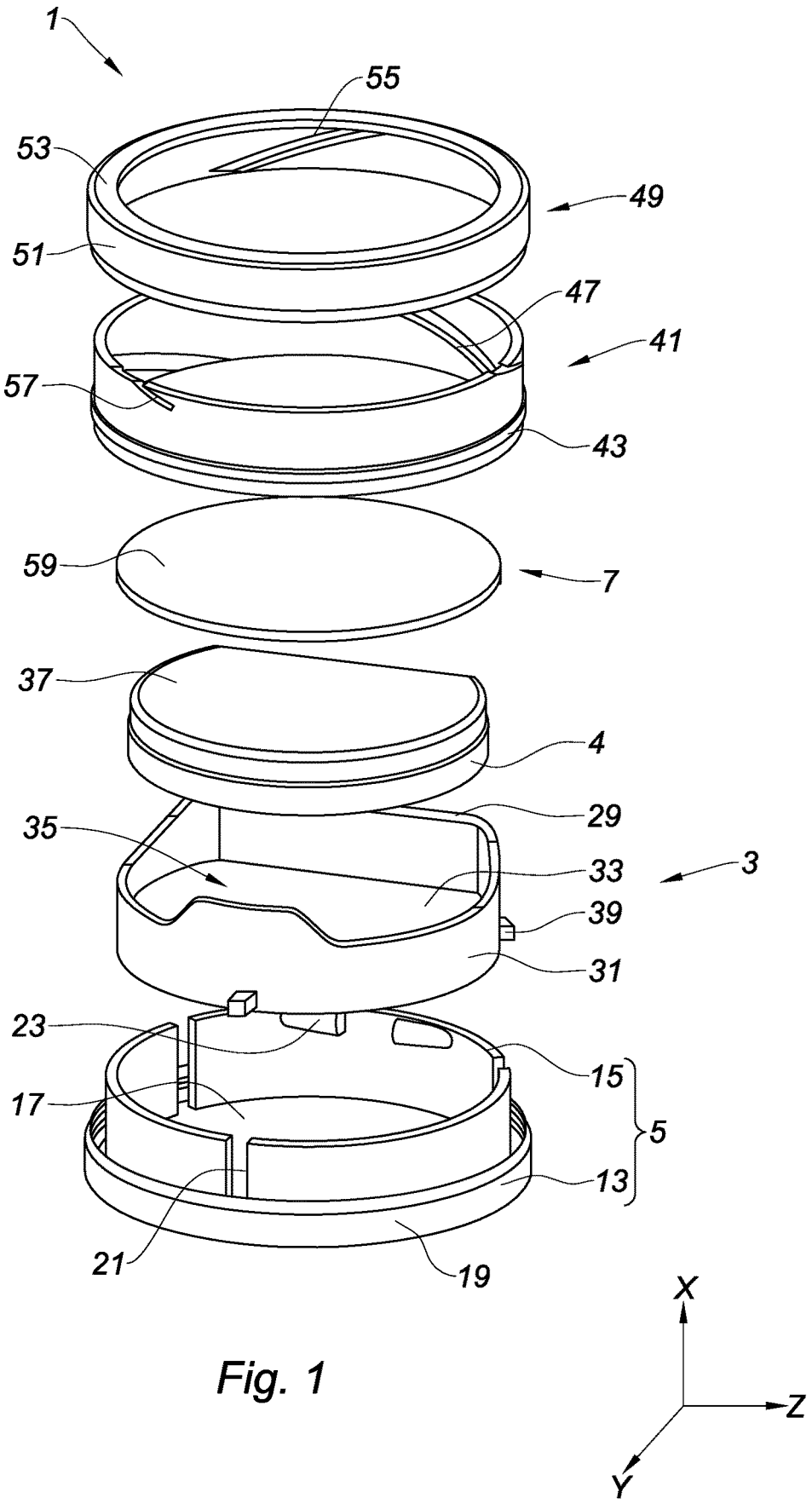
FIG. 1 is an exploded view in perspective of a first embodiment of a case for a cosmetic product according to the invention.

FIGS. 1 to 5 show a first embodiment of a case 1 for a cosmetic product according to the invention including:

a tray 3 intended to receive the cosmetic product 4, an actuating means 5 allowing for the passage of the tray 3 from a rest position to a position of use, a cover 7.

The tray 3 includes in particular a notched zone, which is here a rack 9, able to cooperate with a toothed wheel of the cover 7, which is here a pinion 11, in such a way that the passage of the tray 3 from the rest position to the position of use results in the opening and/or the closing of the cover 7 as can be seen in FIGS. 2 to 5.

In the following description, reference is made to the trihedral X, Y, Z shown in FIGS. 1 to 10. The axis X is the main direction of longitudinal extension of the case, referred to as the main direction, the axis Z is an axis orthogonal to the X axis and parallel to the plane defined by a bottom of the case and parallel to the axis of rotation of the cover and finally the axis Y is an axis orthogonal to the axes X and Z.

In a non-limiting manner, the terms "upper" and "high" or "lower" and "low" are used in reference to the axis X. The terms "inside" and "inner" are used with respect to the case in order to designate an element directed towards the centre of the case and the terms "outside" and "outer" are used with respect to the case to designate an element directed towards the outside of the case.

Advantageously, in this embodiment several elements arranged on the various parts including the case 1 participate in the opening and/or closing mechanism of the cover 7 and in the passage of the tray 3 from the rest position to the position of use. This mechanism will be called mechanism for actuating in what follows.

In this embodiment, the actuating means 5, which could also have been called driver, is of circular shape and includes a bottom part 13 and an inner ring 15 which are a single part.

The bottom part 13 has a bottom 17 and an outer edge 19. The edge 19 extends over the entire perimeter. The outer surface of the edge 19 can be seen from the outside once all of the parts are assembled and the case 1 formed, the bottom 17 corresponds to the bottom of the case 1.

The inner ring 15 includes at least one slot 21, here three, participating in the mechanism for actuating. The three slots 21 extend along the X axis and are regularly angularly distributed all around the inner ring 15. In other words, each one of the slots 21 form a guide path or a through-groove for an extension of material, such as a cam as shall be seen in what follows.

The inner ring 15 also includes fastening means 23 of the cover 7. This can be as shown here, as a perforation of two protuberances on the inner surface of the ring 15 between which are inserted a cylindrical portion 25 of the pinion 11 also perforated. A pin 27 is threaded into each one of the perforations in order to maintain the cover 7 fixed to the case 1 but also to form a pivot axis of the cover 7, parallel to the axis Z, in order to allow for the opening thereof and/or the closing thereof. The pinion 11 is as such fixed by a pivot connection to the inner ring 15 of the actuating means 5. Any other fixation of the cover could be considered as long as this fixation allows fort a pivot connection. This could be for example a snap-fitting of the cover onto a cylindrical part of the inner ring.

The tray 3, which could also have been called bucket holder, generally has a circular profile with a flat zone 29. The outer diameter of the tray 3 is less than the inner diameter of the inner ring 15. The tray 3 is as such housed in the inner ring 15 and rests on the bottom part 13.

All or a portion of this flat zone 29 corresponds to the rack 9 that cooperates with the pinion 11 of the cover 7. In addition, this flat zone 29 makes it possible to form a housing in order to receive the pinion 11 and the fastening means 23 of the cover 7 to the actuating means 5.

The tray 3 includes on the other hand a circumferential wall 31 and a bottom 33 delimiting a compartment 35 for receiving, for example the cosmetic product 4. The cosmetic product can be contained in a bucket placed on the tray.

An applicator 37 can possibly be stored, as shown here on the cosmetic product 4. It can also be considered to use a tray 3 with several compartments, for example superimposed as in the example of the second embodiment described hereinbelow. Two compartments can as such be considered, an upper compartment for the cosmetic product and a lower compartment for the applicator. The two compartments can also be on the same level and adjacent.

The height of the wall 31 can be variable, in particular to allow for a good maintaining of the applicator 37 while still leaving the possibility to grasp it easily. As shown here, the wall 31 is higher on the flat zone 29 and on a portion opposite the flat zone 29.

Advantageously, the tray 3 also includes at least one cam 39, here three, configured to participate in the mechanism for actuating. The cams 39 are regularly angularly distributed over the entire outer surface of the wall 31 of the tray 3 and more particularly over the lower portion of the wall 31.

The term cam means an extension of material, such as a pin, a pawl, in other words a guide finger that cooperates with a guide path such as a groove mentioned hereinabove. As mentioned hereinafter, the cams will make it possible to guide in translation the tray from the rest position to the position of use and inversely.

The case 1 further includes an intermediate ring 41 that is fixed with respect to the actuating means 5.

The inner diameter of the intermediate ring 41 is substantially equal to the outer diameter of the inner ring 15 in such a way that the intermediate ring 41 is positioned around the inner ring 15. While the outer diameter of the intermediate ring 41 is substantially equal to the inner diameter of the edge 19 of the bottom part 13. Consequently, the lower portion of the intermediate ring 41 is towards the inside of the case 1 with respect to the edge of the bottom part 13. In other words, the lower portion of the intermediate ring 41 is as such sandwiched between the outer edge 19 of the bottom part 13 and the inner ring 15. The edge and the inner ring as such form a guide path for the intermediate ring facilitating the centering thereof and the assembly of the parts.

The intermediate ring 41 is assembled by snap-fitting to the actuating means 5. As such, the outer surface of the intermediate ring 41 includes on its lower portion a bulge 43 configured to cooperate with a groove 45 on the inner surface of the edge 19 of the bottom part 13 in such a way as to block in translation the intermediate ring 41 with respect to the actuating means 5 and maintain the assembly of the two parts. Any other fixation that makes it possible to block the intermediate ring 41 in translation while still leaving free the setting in rotation of the actuating means 5 could be considered.

The intermediate ring 41 includes moreover on its inner surface at least one groove 47, here three, participating in the mechanism for actuating. These are, here, helical grooves 47 configured to cooperate with the cams 39 of the tray 3 in such a way as to allow the passage of the tray 3 from the rest position to the position of use and inversely.

Furthermore, the case 1 of this embodiment includes an upper ring 49. The upper ring 49 includes an axial wall 51 and an upper radial edge 53 extending from the axial wall 51 to the center of the upper ring 49. The upper ring 49 as such has a first inner diameter delimited by the axial wall 51 greater than a second diameter delimited by the radial edge 53.

The upper ring 49 is configured to pass from a high position to a low position, and inversely. In the high position, the outer surface of the cover 7 and the top of the upper ring 49, in particular the outer surface of its radial edge 53, are aligned. In other words, the outer surface of the radial edge 53 is flush with the outer surface of the cover 7 in the rest position. A case is as such obtained in the aesthetic rest position and without an attachment point. In the low position, the upper ring 49, in particular its wall 51, covers the intermediate ring 41, the top of the ring 49 being below the outer surface of the cover 7. In other words, the cover 7 is raised in relation to the intermediate ring which facilitates its opening and/or its closing. The width of the radial edge 53 is substantially equal to the sum of the thicknesses of the intermediate ring 41 and of the inner ring 15 and as such makes it possible to hide the edges of these two rings.

Moreover, the upper ring 49 includes at least one groove 55 which extends helically, here three, located on the inner surface of its axial wall 51 and regularly angularly distributed over the latter. These grooves 55 are configured to cooperate with at least one rib 57 also extend helically and are arranged on the outer surface of the intermediate ring 41.

The grooves 55 of the upper ring 49 and the ribs 57 of the intermediate ring 41 are directed in a direction opposite the grooves 47 of the inner surface of the intermediate ring 41 in order to allow the upper ring 49 to rise while the tray 3 passes from the rest position to the position of use, and inversely, in such a way as to allow the opening and/or the closing of the cover 7. As such, in a first step, the rotation of the actuating means 5 drives the lowering of the upper ring 49. The radial edge of the ring is under the outer surface of the cover 7. The system of grooves 55, 57 in the opposite direction allows for an intuitive movement of the two rings 41, 49 in order to initiate the passage of the cover 7 from the rest position to the position of use and inversely.

In this embodiment, the cover 7 is circular and substantially flat. It has a diameter substantially identical to the second inner diameter of the upper ring 49 in order to be able to be placed inside the latter and provide the seal to impurities of the case in the rest position.

The cover 7 includes a cap portion 59 that covers the cosmetic product 4 and provides the protection thereof. The periphery of the cap 59 is in contact with the wall 31 of the tray 3 on the high zones of the latter. This support participates in maintaining the cover in the closed position. The cover 7 also includes an end portion 61 located on pinion 11 and facing the flat zone 29 of the tray 3 in the rest position.

Figure 2:
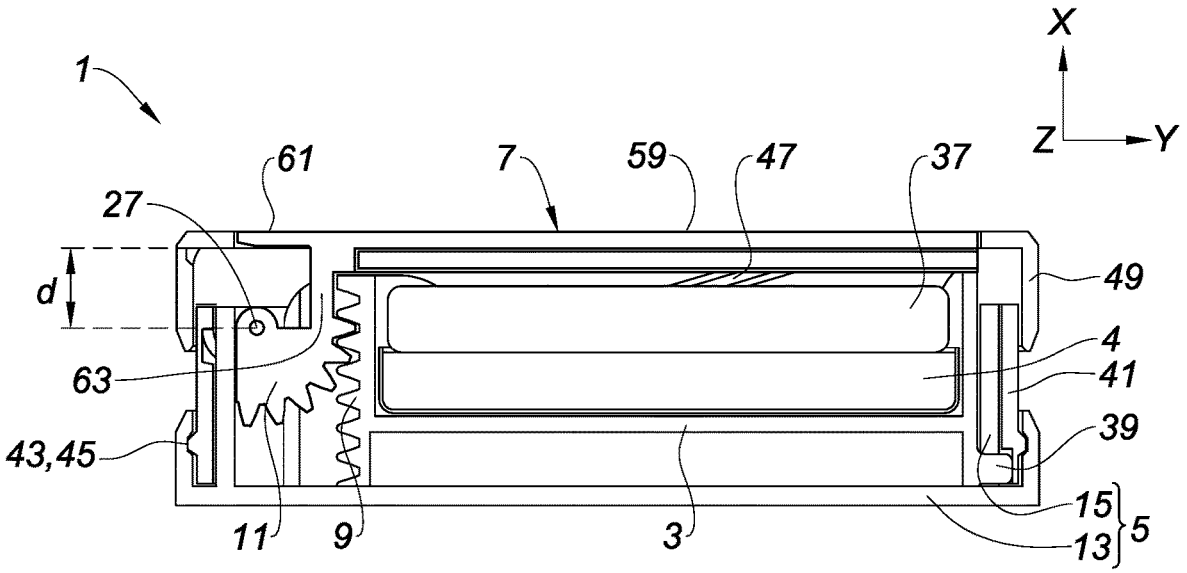
FIG. 2 is a longitudinal cross-section of the case shown in FIG. 1, wherein a tray is in the rest position.
Figure 5:
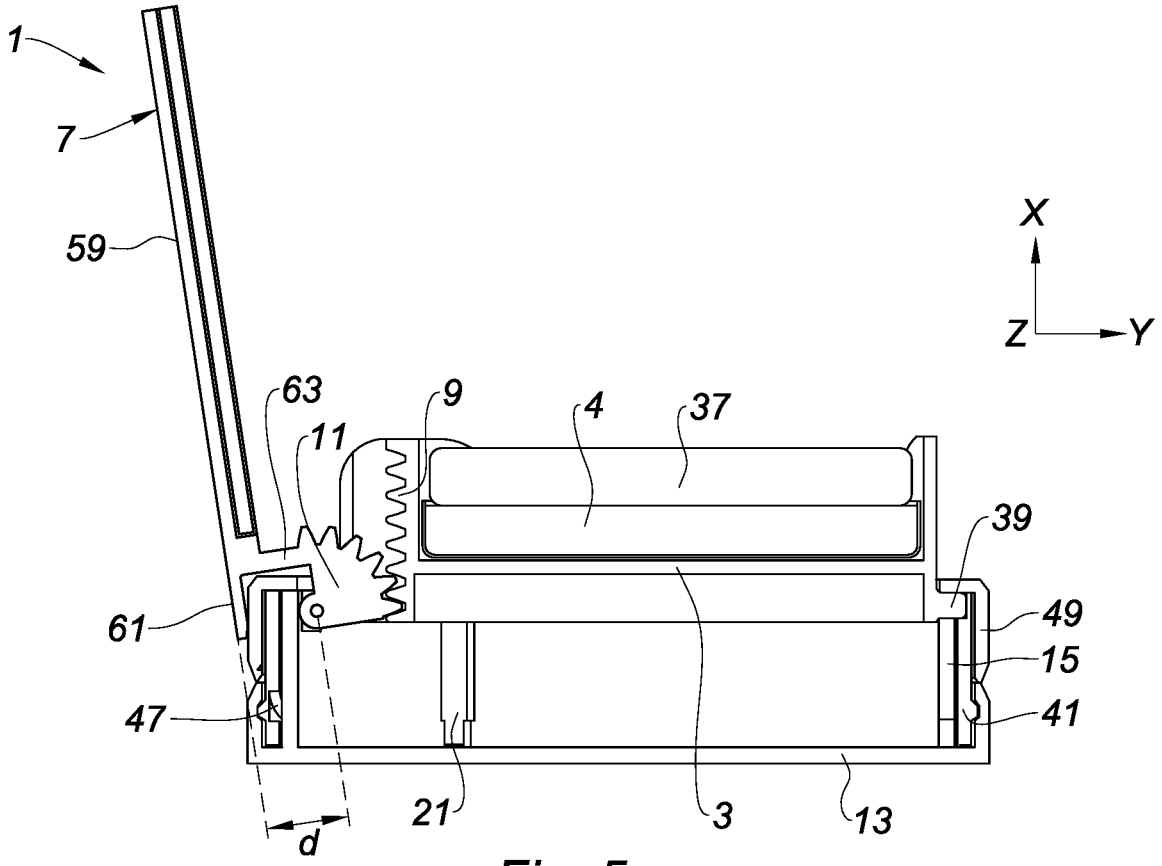
FIG. 5 is a longitudinal cross-section of the case shown in FIG. 1, wherein the tray is in the position of use.
Figure 6:
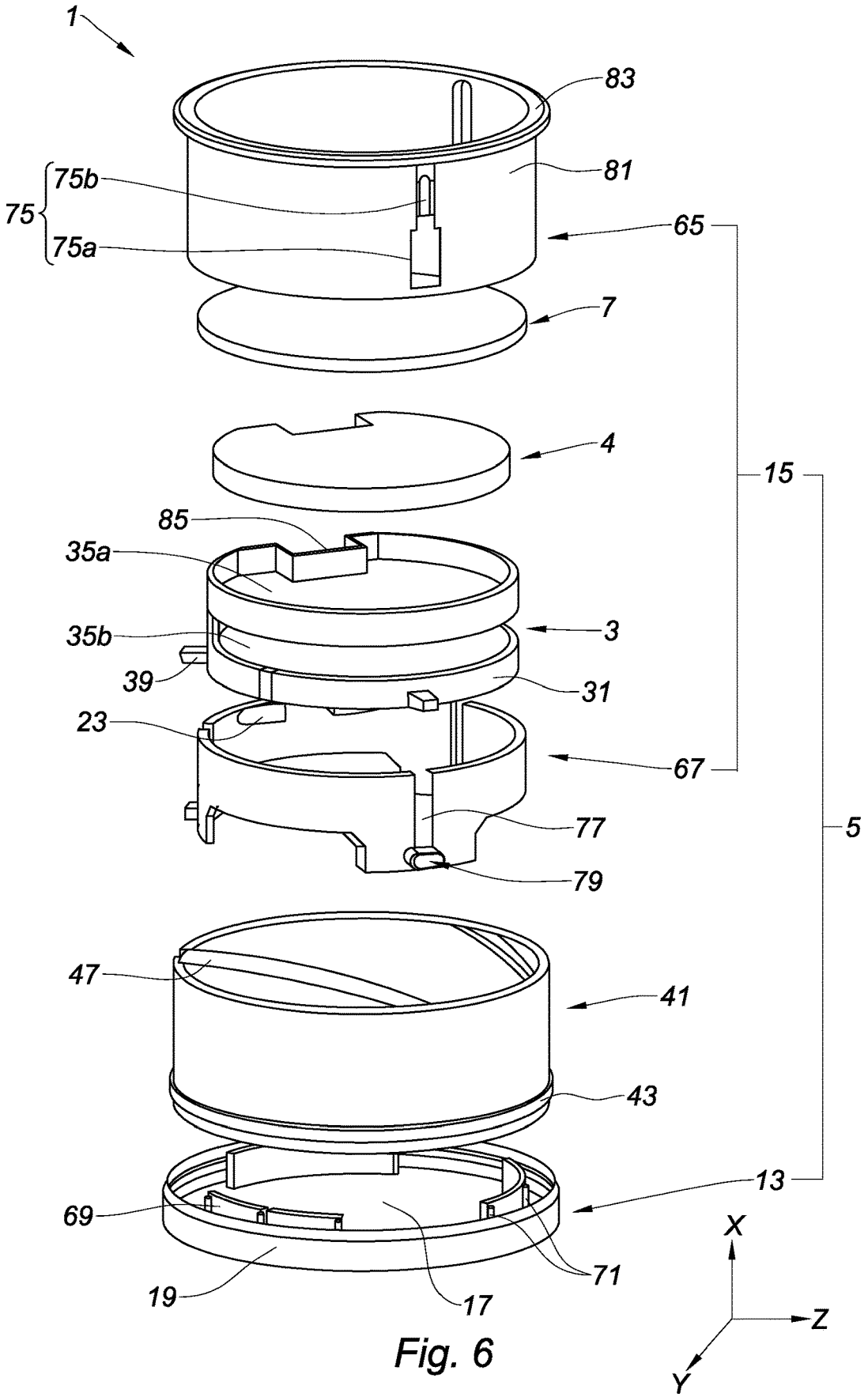
FIG. 6 is an exploded view in perspective of a second embodiment of a case for a cosmetic product according to the invention.
Figure 7:
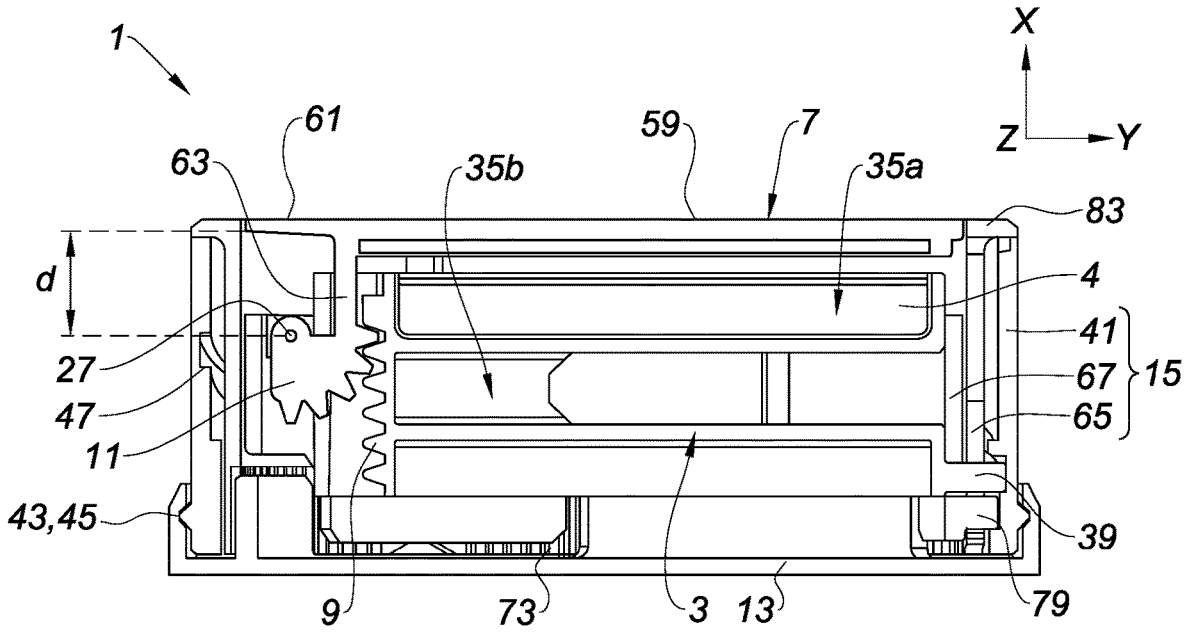
FIG. 7 is a longitudinal cross-section of the case shown in FIG. 6, wherein a tray is in the rest position.
Figure 8:
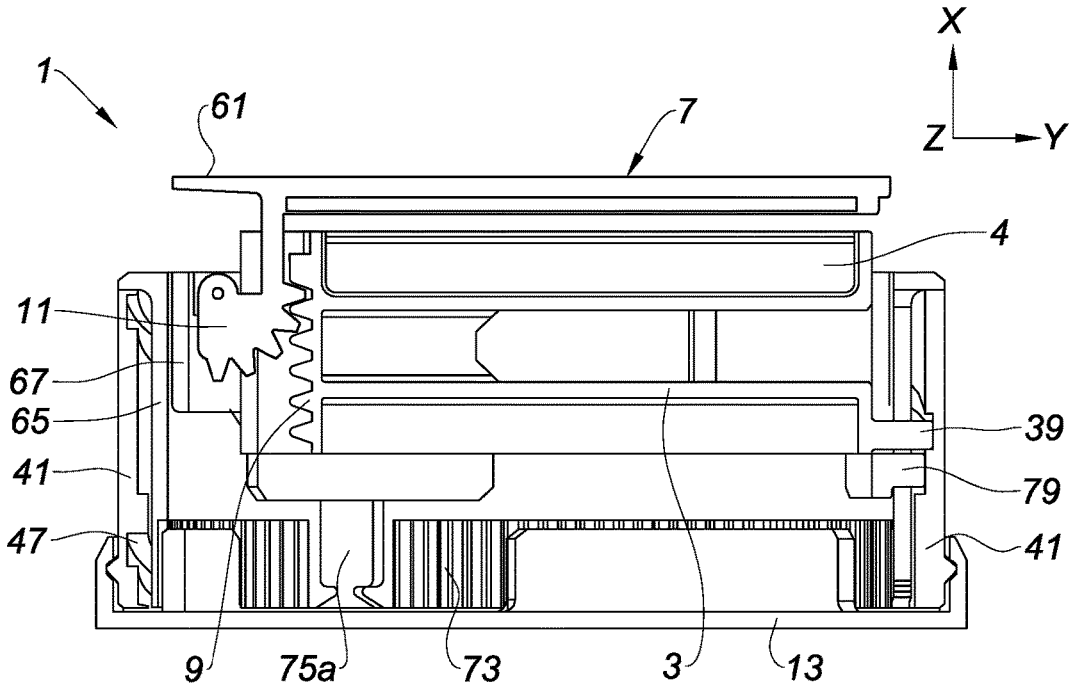
FIG. 8 is a longitudinal cross-section of the case shown in FIG. 6 in the process of opening.
Figure 9:
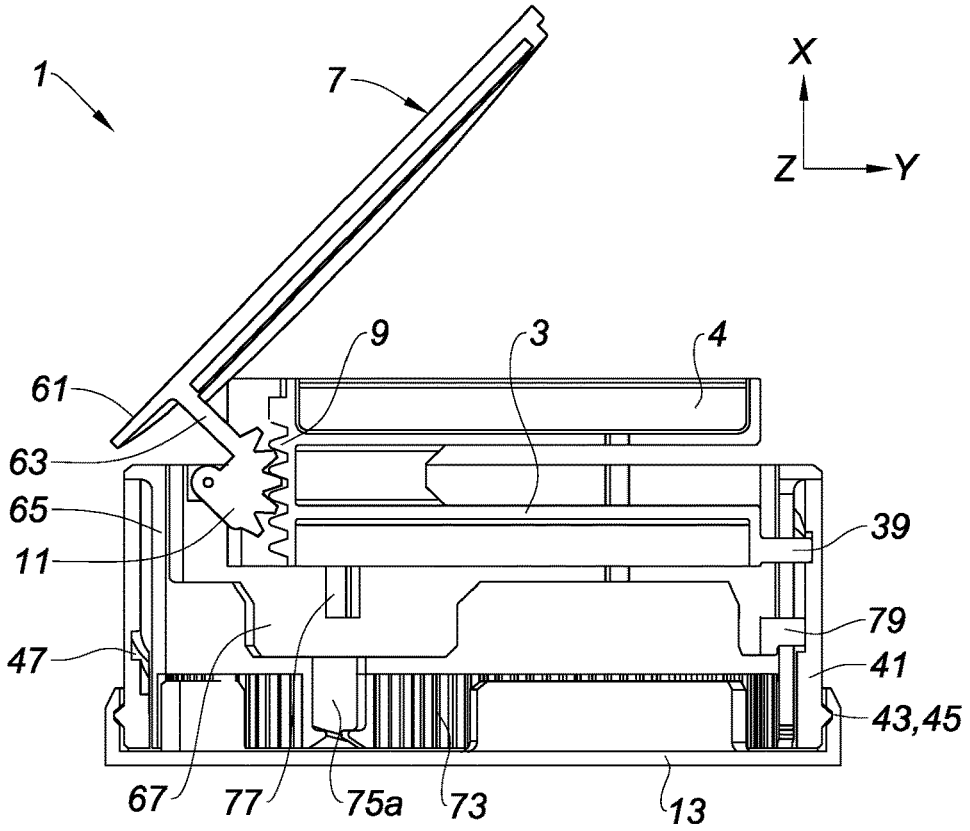
FIG. 9 is a longitudinal cross-section of the case shown in FIG. 6 in the process of opening.
Figure 10:
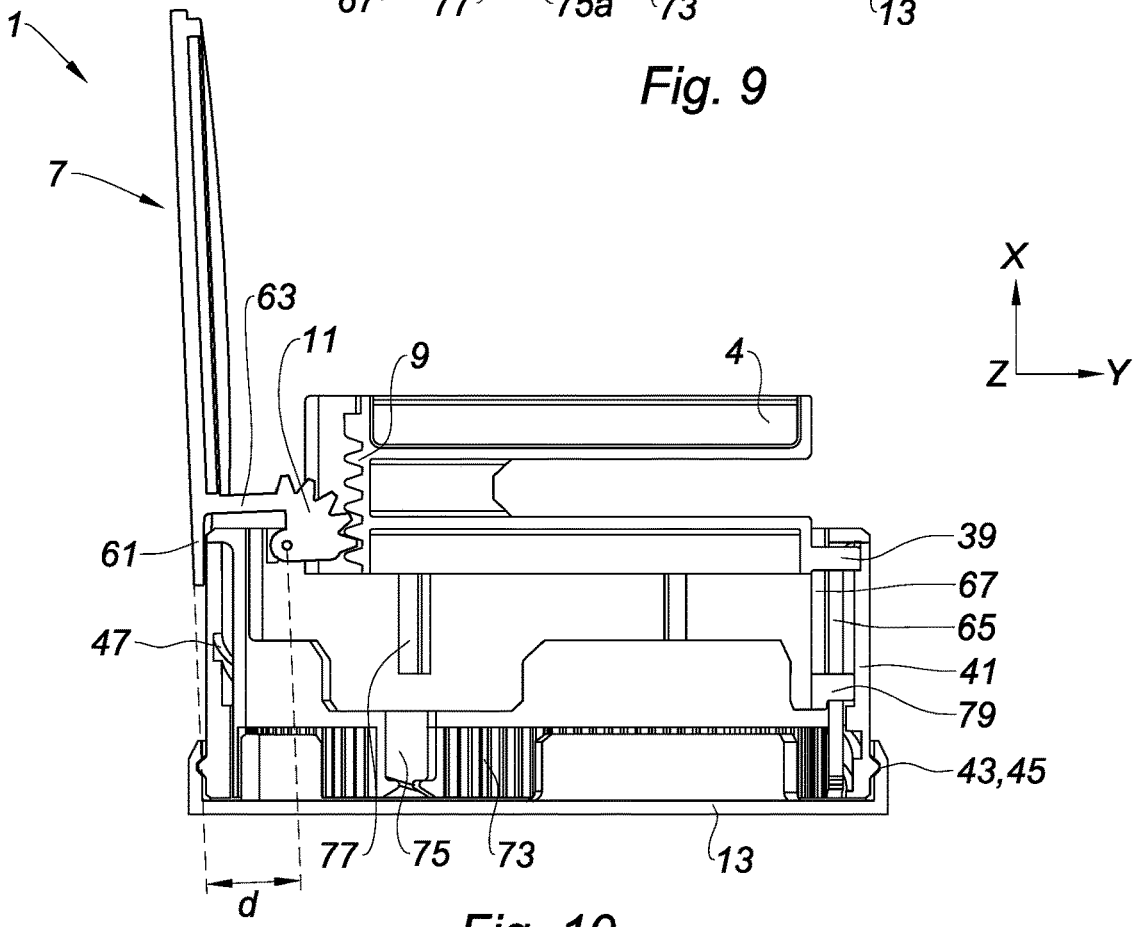
FIG. 10 is a longitudinal cross-section of the case shown in FIG. 6, wherein the tray is in the position of use.

The end portion 61 has a width that makes it possible to hide the pinion 11 and the rack 9 in the rest position as can be seen in FIG. 2. The end portion 61 is also configured to serve as a stop for the cover 7 in the position of use as can be seen in FIG. 5. The stop makes it possible to maintain the cover 7 open with an angle substantially greater than or equal to 90°.

Preferably, the pinion 11 of the cover 7 cooperating with the rack 9 of the tray 3 is arranged at the end of a rod 63. The term rod means for example a finger of material that allows for the offsetting of the pinion 11 with respect to the cover 7. Preferably, the rod 63 comes from the material of the cover 7. It is also possible to provide a fastening by gluing, welding, snap-fitting or any other means that allow for the offsetting of the pinion 11 with respect to the cover 7. In other words, this rod 63 makes it possible to form an interaxis d between the axis of rotation of the pinion 11 and an inner surface of the end portion 61 of the cover 7 allowing for the pivoting of the cover 7 into the position of use without the periphery of the cover 7 abutting against the upper ring 49.

As can be seen in FIG. 5, the interaxis d corresponds to the sum of the thicknesses of the inner ring 15, of the intermediate ring 41 and of the upper ring 49, which is the width of the radial edge 53 of the upper ring 49. The interaxis is as such configured to allow for the complete opening of the cover 7.

In this embodiment, the interaxis d makes it possible to offset the end portion 61 of the cover 7. Without this offset, the end portion 61 would abut, here, against the radial edge 53 of the upper ring 49 before reaching the complete opening of the cover 7. In other words, without this offset the opening of the cover 7 would not be possible without damaging it, in particular without damaging the end portion 61 of the cover 7. The offset also makes it possible to maintain the cover 7 aligned with the outer surface of the radial edge 53 of the upper ring 49 in the rest position. Such a configuration of the cover 7 makes it possible as such to facilitate the opening and the closing of the cover 7, while retaining the aesthetics of the case 1.

The opening of the case 1, in other words the passage of the tray 3 from its rest position to its position of use shall now be described in reference to FIGS. 2 to 5.

Advantageously, the combination of grooves, slots and cams on the different elements of the case 1 causes a translation of the tray 3 when the actuating means 5 is set into rotation. The rack 9 located on the tray 3 undergoes by the same occasion a translation causing a rotation of the pinion 11 which results in the opening of the cover 7.

Figure 3:
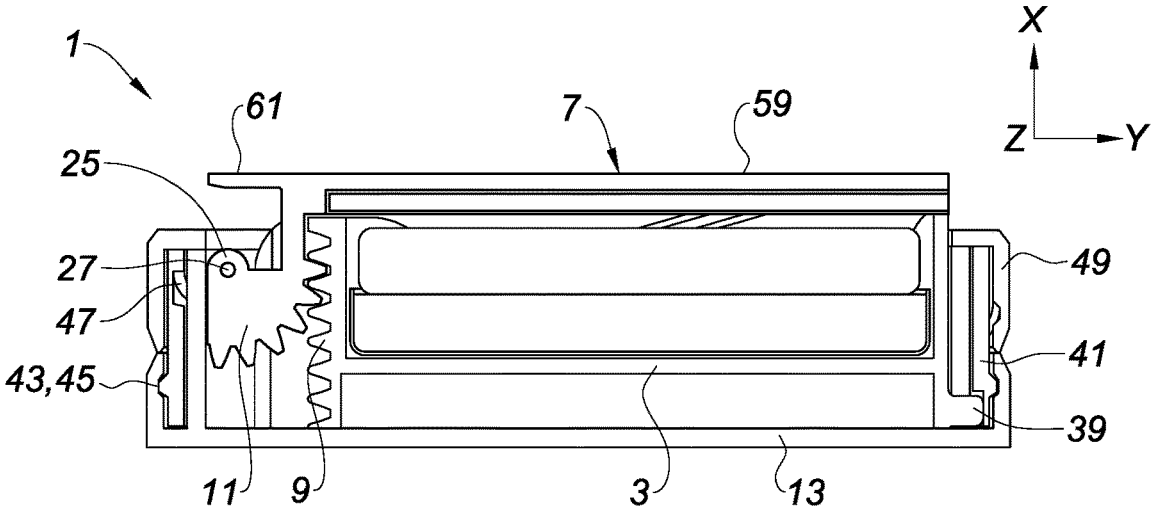
FIG. 3 is a longitudinal cross-section of the case shown in FIG. 1 in the process of opening.

In a first step, the setting in rotation of the actuating means 5 drives the lowering of the upper ring 49 as can be seen in FIG. 3. Indeed, the rotation of the actuating means 5 drives a rotation of the upper ring 49 in an opposite direction and the lowering thereof via cooperation of the outer helical rib 57 of the intermediate ring 41 with the inner helical groove 55 of the upper ring 49.

Figure 4:
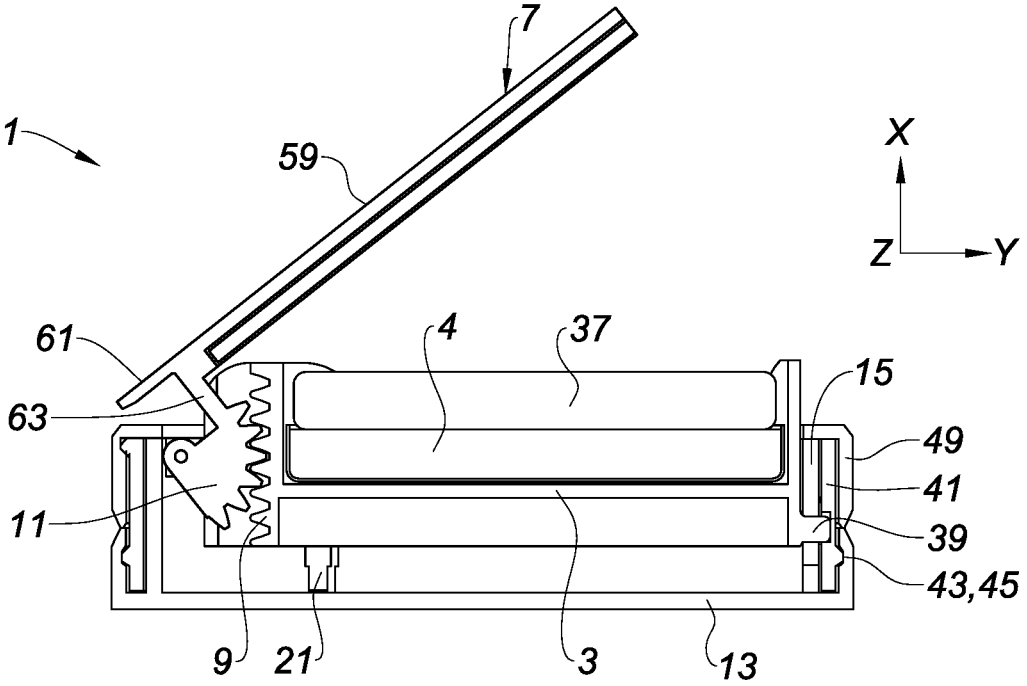
FIG. 4 is a longitudinal cross-section of the case shown in FIG. 1 in the process of opening.

In what follows, the maintaining in rotation of the actuating means 5 drives the raising of the tray 3 and the opening of the cover 7 as shown in FIG. 4. During the assembly, the cams 39 of the tray 3 are inserted into the slots 21 of the inner ring 15. The tray 3 is as such coupled in rotation with the actuating means 5. In parallel, the cams 39 of the tray 3 cooperate with the inner helical grooves 47 of the intermediate ring 41 which causes the tray 3 to rise. The tray 3 carries out a movement of translation with respect to the actuating means 5.

Simultaneously, the rising of the tray 3 results in the opening of the cover 7. Indeed, the rack 9 located on the circumferential wall 31 of the tray 3 also undergoes a movement of translation. The rack 9 cooperating with the pinion 11 of the cover 7, this movement of translation causes a rotation of the pinion 11 of the cover 7 and the opening thereof.

The interaxis d between the cover 7 and the pinion 11 allows for a complete opening of the cover 7. In this embodiment as can be seen in FIG. 5, the end portion 61 of the cover 7 abuts against the axial wall 51 of the upper ring 49 and as such makes it possible to stop the opening of the cover, in particular when the cams 39 of the tray 3 reach the end of their guide path and the tray 3 has reached its position of use.

Advantageously, less than one turn of revolution of the actuating means 5 is required for the complete opening of the case 1. Preferably, a half-turn, even a quarter-turn, is sufficient.

The closing mechanism is similar and the steps are in the reverse order. The setting in rotation of the actuating means 5 in the opposite direction, causes the lowering of the tray 3 by a movement of translation downwards with respect to the actuating means 5 and a rotation of the pinion 11 and the closing of the cover 7. The continuation of the setting in rotation of the actuating means 5 drives the rotation of the upper ring 49 and the passage thereof into high position. The case 1 is then completely closed.

The movement of the upper ring 49 makes it possible to release the end portion 61 of the cover 7 and to prevent it from abutting against the upper ring 49 before the complete opening of the cover 7 During the closing of the case 1, after the lowering of the tray 3, the rotation of the actuating means 5 drives the raising of the upper ring 49 in high position.

The case according to this first embodiment of the invention is a compact cosmetic case including an original opening and/or closing system.

Indeed, the arrangement of the parts between one another, in particular of the concentric rings, makes it possible to obtain a case that is compact and easy to assemble.

In addition, the system of cams and cam paths is a system that is easy to implement that makes it possible via a simple setting into rotation by the user of the actuating means not only to open the case but also to improve the accessibility of the cosmetic product by the passage of the tray from a rest position to a position of use.

On the other hand, the pinion/rack system allows for an opening of the cover simultaneously with the passage of the tray from the rest position to the position of use, and inversely, via the simple putting into rotation of an actuating means. This system allows in particular for the opening of a cover that has a substantial weight, caused for example by the presence of a mirror.

A case 1 according to a second embodiment shall now be described in relation with FIGS. 6 to 10.

It includes as hereinabove:

a tray 3 intended to receive the cosmetic product, an actuating means 5 allowing for the passage of the tray 3 from a rest position to a position of use, a cover 7.

The tray 3 includes in particular a notched zone, which is here a rack 9, able to cooperate with a toothed wheel of the cover 7, which is here a pinion 11, in such a way that the passage of the tray 3 from the rest position to the position of use results in the opening and/or the closing of the cover 7 as can be seen in FIGS. 7 to 10.

This second embodiment also includes an intermediate ring 41 similar to that of the first embodiment.

In this second embodiment, the inner ring 15 and the bottom part 13 of the actuating means 5 are two separate parts. The inner ring 15 is also included of a first and second parts 65 and 67 which are concentric. The first part 65 is located outside the second part 67. This breaking down of the actuating means 5 into several parts makes it possible to slightly modify the mechanism for actuating as mentioned in what follows while still retaining the opening and/or the closing of the cover 7 driven by the passage of the tray 3 from the rest position to the position of use, and inversely.

The bottom part 13 includes as in the preceding embodiment a bottom 17 and an outer edge 19. It also includes means for assembly 69 with the inner ring 15 and in particular with the first part 65 of the inner ring 15.

As such, the bottom part 13 includes tabs 69 regularly distributed over the bottom 17 at a distance from the outer edge 19 substantially equivalent to the sum of the thicknesses of the intermediate ring 41 and of the inner ring 15. The lower portion of the first part 65 of the inner ring 15 and the lower portion of the intermediate ring 41 are sandwiched between the outer edge 19 and the tabs 69 of the bottom part 13. The surface of the tabs 69 turned towards the outside of the case 1 includes teeth 71 cooperating with a toothed portion 73 of the inner ring 15, here of the first part 65 of the inner ring 15. The bottom part 13 and the inner ring 15 are as such in serrated assembly in such a way that the setting into rotation of the bottom part 13 drives the rotation of the inner ring 15.

Each one of the first and second parts 65, 67 of the inner ring 15 includes at least one slot 75, 77, here three on each one of the parts, participating in the mechanism for actuating. The slots 75, 77 extend along the X axis and are regularly angularly distributed all around each one of the parts. The slots 75 of the first part 65 are divided into a lower portion 75*a* and an upper portion 75*b*, with the width of the lower portion 75*a* being greater than the width of the upper portion 75*b*. Once the two parts 65, 67 are assembled to form the case 1, the slots 75, 77 of each one of the parts are facing. Here again, each one of the slots 75, 77 form a guide path, in particular for the passage of the tray via the passage of the tray 3 from the rest position to the position of use, and inversely.

The second part 67 further includes at least one cam 79, here three, participating in the mechanism for actuating. The cams 79 are regularly angularly distributed over the lower portion of the second part 67. The width of the cams 79 correspond to the width of the lower portion 75*a* of the slots 75 of the first part 65. The cams 79 are as such configured to cooperate with the slot 75 of the first part 65. In other words, the slots 75 serve as a guide path for the cams 79 of the second part 67 and allow for the displacement thereof according to the X axis.

In this embodiment, as hereinabove, the term cam means an extension of material, such as a pin, a pawl, in other words a guide finger cooperating with a guide path such as a groove mentioned hereinabove. The cams will make it possible to guide in translation the tray from the rest position to the position of use and inversely.

The first part 65 of the inner ring 15 has an axial wall 81 and a radial edge 83 extending from the top of the axial wall 81 towards the outside of the inner ring 15. This radial edge 83 rests on the upper end of the intermediate ring 41.

The tray 3 of the second embodiment differs from the tray of the first embodiment. It includes two compartments 35*a*, 35*b*, an upper compartment 35*a* for receiving for example the cosmetic product 4 and a lower compartment 35*b* for receiving for example an applicator (not shown) such as a sponge. The cosmetic product 4 can be contained in a bucket. It is however possible to consider using the tray 3 of the first embodiment with a single compartment.

The tray 3 has a substantially circular profile and includes a recess 85. All or a portion of the outer surface of the recess 85 corresponds to the rack 9. This recess 85 also makes it possible to house the pinion 11 of the cover 7.

Advantageously, the tray 3 also includes at least one cam 39, here three, configured to participate in the mechanism for actuating. The cams 39 are regularly angularly distributed over the entire outer surface of the wall 31 of the tray 3 and more particularly over the lower portion of the wall 31.

The width of the cams 39 of the tray 3 is different from the width of the cams 79 of the second part 67. It is, for example, as in this embodiment less than the width of the cams 79 of the second part 67. More precisely, the width of the cams 39 of the tray 3 is substantially identical to the width of the slot 77 of the second part 67 and to the width of the upper portion 75*b* of the slot 75 of the first part 65. The width of the cams 79 of the second part 67 is substantially identical to the width of the lower portion 75*a* of the slot 75 of the first part 65. Consequently, the change in width of the slot 75 of the first part 65 is used as a stop for the cams 79 of the second part 67 in such a way as to block the second part 67 in the displacement thereof upwards. On the other hand, the tray 3 can continue to rise until the position of use and allow for the opening of the cover 7.

As mentioned hereinabove, the case 1 includes an intermediate ring 41 similar to that described in the first embodiment. This ring 41 includes a bulge 43 in order to be assembled by snap-fitting to the actuating means 5. The intermediate ring 41 also includes on its inner surface at least one groove 47, here three, participating in the mechanism for actuating. These are, here, helical grooves 47 configured to cooperate with the cams 39 of the tray 3 in such a way as to allow the passage thereof from the rest position to the position of use.

The cover 7 is also similar to that of the first embodiment. It is fixed with a pin 27 on the second part 67 in a manner similar to the first embodiment. The pinion 11 is as such fixed by a pivot connection forming an axis of rotation parallel to the axis Z.

The pinion 11 is arranged at the end of a rod 63. Here again, the term rod means for example a finger of material that allows for the offsetting of the pinion 11 with respect to the cover 7. Preferably, the rod 63 comes from the material of the cover 7. It is also possible to provide a fastening by gluing, welding, snap-fitting or any other means that allow for the offsetting of the pinion 11 with respect to the cover 7. In other words, this rod 63 makes it possible to form an interaxis d between the axis of rotation of the pinion 11 and an inner surface of the end portion 61 of the cover 7 allowing for the pivoting of the cover 7 into the position of use without the periphery of the cover 7 abutting against the radial edge 83 of the first part 65. In this second embodiment, the interaxis d corresponds to the sum of the thicknesses of the first and second parts 65, 67 of the inner ring 15 and of the intermediate ring 41.

As hereinabove, in this second embodiment, the interaxis d makes it possible to offset the end portion 61 of the cover 7. Without this offsetting, the opening of the cover 7 would not be possible without damaging it, in particular without damaging the end portion 61 of the cover 7. The offset also makes it possible to maintain the cover 7 aligned with the outer surface of the radial edge 83 of the first part 65 in the rest position. This alignment provides a seal to impurities and prevents having an attachment point of the cover 7 in the rest position. Such a configuration of the cover 7 makes it possible as such to facilitate the opening and the closing of the cover 7, while retaining the aesthetics of the case 1.

Although not shown, the upper ring 49 of the first embodiment could also be considered in this second embodiment.

The opening of the cover 7 shall now be described in reference to FIGS. 7 to 10. The mechanism is substantially similar to that of the first embodiment. The combination of grooves, of slots and of cams on the different elements of the case 1 causes a translation of the tray 3 from the rest position to the position of use when the actuating means 5 is set into rotation. The rack 9 located on the tray 3 undergoes by the same occasion a translation causing a rotation of the pinion 11 results in the opening of the cover 7.

In a first step, the setting in rotation of the actuating means 5 drives the raising of the tray 3 and the exit thereof from the case 1.

Indeed, the bottom part 13 and the first part 65 of the inner ring 15 are in a serrated assembly. The setting into rotation of the bottom part 13 drives the rotation of the first part 65. The cams 79 of the second part 67 of the inner ring 15 are inserted into the slots 75 of the first part 65 and the cams 39 of the tray 3 are inserted into the slots 75, 77 of the first and of the second parts 65, 67. The tray 3 and the second part 67 are as such coupled in rotation with the first part 65. The tray 3 is coupled in rotation and in translation with the second part 67. In parallel, the cams 39 of the tray 3 cooperate with the inner helical grooves 47 of the intermediate ring 41.

As such, the setting into rotation of the bottom part 13 drives the rotation of the first part 65 and the raising of the tray 3 which simultaneously causes the second part 67 to rise. As the cover 7 is fixed to the second part 67, the simultaneous raising of the tray 3 and of the second part 67 does not cause a rotation of the pinion 11 and in a first step, the cover 7 remains closed.

In what follows, the change in width of the slot 75 of the first part 65 and the differences in width and in radial extension of the cams 39, 79 of the tray 3 and of the second part 67 stop the rising of the second part 67 while the tray 3 continues to rise. In other words, as the cams 79 of the second part 67 are wider than the cams 39 of the tray 3, they are stopped in their movement in translation when the width of the slots 75 decreases. In addition, as the cams 79 of the second part 67 are shorter than the cams 39 of the tray 3, they do not cooperate with the grooves 47 of the intermediate ring 41 and therefore do not follow this guide path contrary to the tray 3. The tray 3 and therefore the rack 9 then continue their movement. This is in particular a movement of translation in relation to the second part 67 and therefore of the pinion 11 fixed to the second part 67, which provokes a rotation of the pinion 11 of the cover 7 and the opening thereof.

The interaxis d between the cover 7 and the pinion 11 allows for a complete opening of the cover 7 until the end portion 61 of the cover 7 abuts against the intermediate ring 41.

Advantageously, less than one turn of revolution of the actuating means 5 is required for the complete opening of the case 1. Preferably, a half-turn, even a quarter-turn, is sufficient.

The closing mechanism is similar and the steps are in the reverse order. The setting in rotation of the actuating means 5 in the opposite direction, causes the closing of the cover 7 and the lowering of the tray 3 by a movement of translation downwards with respect to the actuating means 5 and a rotation of the pinion 11. Once the cover 7 is closed, the maintaining of the setting in rotation of the actuating means 5 causes the tray 3 to descend to its rest position and the complete closure of the case 1.

Here again, this second embodiment according to the invention makes it possible to obtain a compact cosmetic case including an original opening and/or closing system.

Although the mechanism for actuating differs from the one of the first embodiment, with in particular an exit of the tray before the opening of the cover, there are still the cam/cam path and pinion/rack systems that make it possible by a simple putting into rotation to improve the accessibility of the cosmetic product by the passage of the tray in the position of use and the opening of the cover.

In each of the embodiments, the materials of the parts are chosen primarily according to the function of the part. Preferably, this is plastic. In particular, the materials of the pinion and of the rack are chosen to resist over the time of their actuating. Advantageously, on the one hand, the pinion and the rack must not grip in order to facilitate the opening and/or the closing of the cover and on the other hand also show a certain resistance for maintaining the tray in the position of use and the cover open.

Advantageously, the different parts are made of thermoplastic materials, for example polypropylene (PP), polyethylene (PE), poly-oxo-methylene (POM), poly-butylene terephtalate (PBT) or acrylonitrile butadiene styrene (ABS). Preferably, the rack 9 and the pinion 11 are made of a material resistant to the mechanical stresses that are imposed upon them, such as POM, PP or PE and more preferably POM, while the parts that are visible from the outside such as the actuating means 5, the tray 3 and the various rings are more preferably made from ABS which is a material that has a more aesthetical finish.

In each one of the embodiments, a locking system can also be considered in order to prevent an untimely rotation of the actuating means 5 and the undesired opening of the case 1, for example when it is in the handbag of the user. This can be for example, a spot that is hard to cross.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description; but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

What is claimed is:

1. A case for a cosmetic product comprising:

a tray adapted to receive the cosmetic product, an actuating means allowing in consequence of a rotation of the actuating means for the passage of the tray from a rest position to a position of use, and a cover, wherein the tray is coupled in rotation with the actuating means and comprises a notched zone able to cooperate with a toothed wheel of the cover so that the passage of the tray from the rest position to the position of use results in an opening of the cover reciprocally and so that the passage of the tray from the position of use to the rest position results in a closing of the cover.

2. The case of claim 1, wherein the case further comprises an intermediate ring that is fixed with respect to the actuating means and comprises on an inner surface of the intermediate ring, at least one groove configured to cooperate with at least one cam of the tray so as to allow raising and/or lowering of the tray.

3. The case of claim 1, wherein the actuating means comprises a bottom part and an inner ring comprising at least one slot configured to cooperate with one or more cams of the tray so as to drive in rotation the tray.

4. The case of claim 3, wherein the inner ring and the bottom part are two separate parts.

5. The case of claim 3, wherein the inner ring and the bottom part are a single part.

6. The case of claim 3, wherein the wheel is fixed to the inner ring.

7. The case of claim 4, wherein the bottom part and the inner ring are disposed in a serrated assembly so that setting into rotation the bottom part drives rotation of the inner ring.

8. The case of claim 3, wherein setting into rotation the inner ring results in a raising and/or lowering of the tray by cooperation with at least one cam of the tray with at least one groove of the intermediate ring and at least one slot of the inner ring.

9. The case of claim 3, wherein the case further comprises an upper ring configured to pass from a high position at which an outer surface of the cover and an outer surface of an upper radial edge of the upper ring are aligned, to a low position at which the upper ring covers the intermediate ring, the top of the upper ring being below the outer surface of the cover, and inversely, so as to allow opening and/or closing of the cover, the intermediate ring further comprising on an outer surface thereof at least one helical rib configured to cooperate with at least one helical groove located on the inner surface of the upper ring, the groove of the inner surface of the intermediate ring being helical, the groove of the upper ring and the rib of the intermediate ring being oriented in a direction opposite the groove of the inner surface of the intermediate ring in order to allow the upper ring to rise while the tray descends and/or inversely so as to allow the opening and/or the closing of the cover.

10. The case of claim 3, wherein the cover comprises an end portion configured to hide at least the toothed wheel in the rest position and serve as a stop for the cover in the position of use.

11. The case of claim 10, wherein an interaxis between an axis of rotation of the toothed wheel and an inner surface of the end portion of the cover allows for pivoting of the cover into the position of use.

* * * * *